US007755291B2

(12) United States Patent
Neil et al.

(10) Patent No.: US 7,755,291 B2
(45) Date of Patent: Jul. 13, 2010

(54) INCANDESCENT LAMP THAT EMITS INFRARED LIGHT AND A METHOD OF MAKING THE LAMP

(75) Inventors: Jeffrey T. Neil, North Reading, MA (US); Victor E. Perez, Manchester, NH (US); Lewis H. Palmer, III, Swampscott, MA (US); Joseph E. Lester, Lincoln, MA (US)

(73) Assignee: Osram Sylvania Inc., Danvers, MA (US)

( * ) Notice: Subject to any disclaimer, the term of this patent is extended or adjusted under 35 U.S.C. 154(b) by 1281 days.

(21) Appl. No.: 11/160,498

(22) Filed: Jun. 27, 2005

(65) Prior Publication Data

US 2005/0212432 A1 Sep. 29, 2005

(51) Int. Cl.
*H01J 17/18* (2006.01)
*H01J 61/36* (2006.01)

(52) U.S. Cl. ..... 313/623; 313/484; 313/493; 313/567; 313/578; 313/238

(58) Field of Classification Search ..... 313/484, 313/493, 567, 569, 578, 579, 580, 623, 624, 313/628, 631, 637, 238
See application file for complete search history.

(56) References Cited

U.S. PATENT DOCUMENTS 3,930,178 A * 12/1975 Coaton ..... 313/275
4,023,060 A * 5/1977 Pike et al. ..... 313/273
4,271,363 A 6/1981 Anderson ..... 250/504 R
4,366,410 A 12/1982 Buhrer ..... 313/221
4,532,455 A 7/1985 Connor et al. ..... 313/579
RE34,018 E * 8/1992 Petersen et al. ..... 338/303
6,075,313 A 6/2000 Verheyen ..... 313/271
6,566,814 B2 5/2003 Johnston et al. ..... 313/623
2004/0036393 A1 * 2/2004 Eastlund et al. ..... 313/26
2004/0056600 A1 * 3/2004 Lapatovich et al. ..... 313/634
2004/0119414 A1 * 6/2004 Bewlay et al. ..... 313/636

FOREIGN PATENT DOCUMENTS

GB 1065025 4/1967

* cited by examiner

*Primary Examiner*—Karabi Guharay
*Assistant Examiner*—Kevin Quarterman
(74) *Attorney, Agent, or Firm*—Robert F. Clark

(57) ABSTRACT

An incandescent lamp that emits infrared light and a method of making the lamp includes a filament assembly inside a polycrystalline aluminum oxide (PCA) envelope, where the filament assembly preferably has a coiled tungsten filament, solid metal ends of tungsten or molybdenum attached to the coiled tungsten filament, and leads at distal ends of the solid metal ends. End caps are attached to ends of the envelope and have openings through which a respective one of the leads extends, where the leads are each made of an electrically conductive material having a coefficient of thermal expansion compatible with the end caps, such as niobium. The leads are attached to the end caps with glass-ceramic sealing frits. The end caps and sealing frits seal a suitable gas inside the envelope.

4 Claims, 1 Drawing Sheet

INCANDESCENT LAMP THAT EMITS INFRARED LIGHT AND A METHOD OF MAKING THE LAMP

BACKGROUND OF THE INVENTION

The present invention is directed to an incandescent lamp that emits infrared light and a method of making such a lamp.

Incandescent lamps with tungsten filaments are commonly used in general lighting. The outer envelope of such lamps is usually glass, which is a satisfactory transmitter of the visible light generated by the tungsten filament. There are uses, however, where the preferred light is infrared instead of visible light. Glass envelopes usually used in incandescent lamps do not transmit the longer infrared wavelengths and thus these common lamps are not useful in the particular applications where infrared radiation wavelengths longer than 4 microns are the desired output from the lamp.

SUMMARY OF THE INVENTION

An object of the present invention is to provide a novel lamp that emits infrared radiation.

It is a further object to provide a novel lamp that has a filament assembly inside a polycrystalline aluminum oxide (PCA) envelope, where the filament assembly preferably has a coiled tungsten filament (single coil or coiled coil), solid metal ends of tungsten or molybdenum attached to the coiled tungsten filament and leads at respective distal ends of the solid metal ends. The lamp desirably has end caps attached to ends of the envelope, where the end caps each have an opening through which a respective one of the leads extends and where the leads are each made of an electrically conductive material having a coefficient of thermal expansion compatible with the end caps. The lamp desirably also has glass-ceramic sealing frits that attach each of the leads to a respective one of the end caps, where the end caps and sealing frits seal a gas inside the envelope.

A yet further object of the present invention is to provide a novel method of making a lamp that emits infrared radiation.

Another object of the present invention is to provide a novel method of making a lamp in which a filament assembly is inserted into a PCA envelope, where the filament assembly has a coiled tungsten filament and solid metal ends of tungsten or molybdenum attached to the coiled tungsten filament and leads at respective distal ends of the solid metal ends. End caps are attached to ends of the envelope and have openings through which respective ones of the leads extends, where the leads are each made of an electrically conductive material having a coefficient of thermal expansion compatible with the end caps. The leads are attached to the respective end caps with glass-ceramic sealing frits and the end caps and the sealing frits seal a gas inside the envelope.

These and other objects and advantages of the invention will be apparent to those of skill in the art of the present invention after consideration of the following drawings and description of preferred embodiments.

DETAILED DESCRIPTION OF THE INVENTION

Figures 1, 2, 3A, 3B, 4:
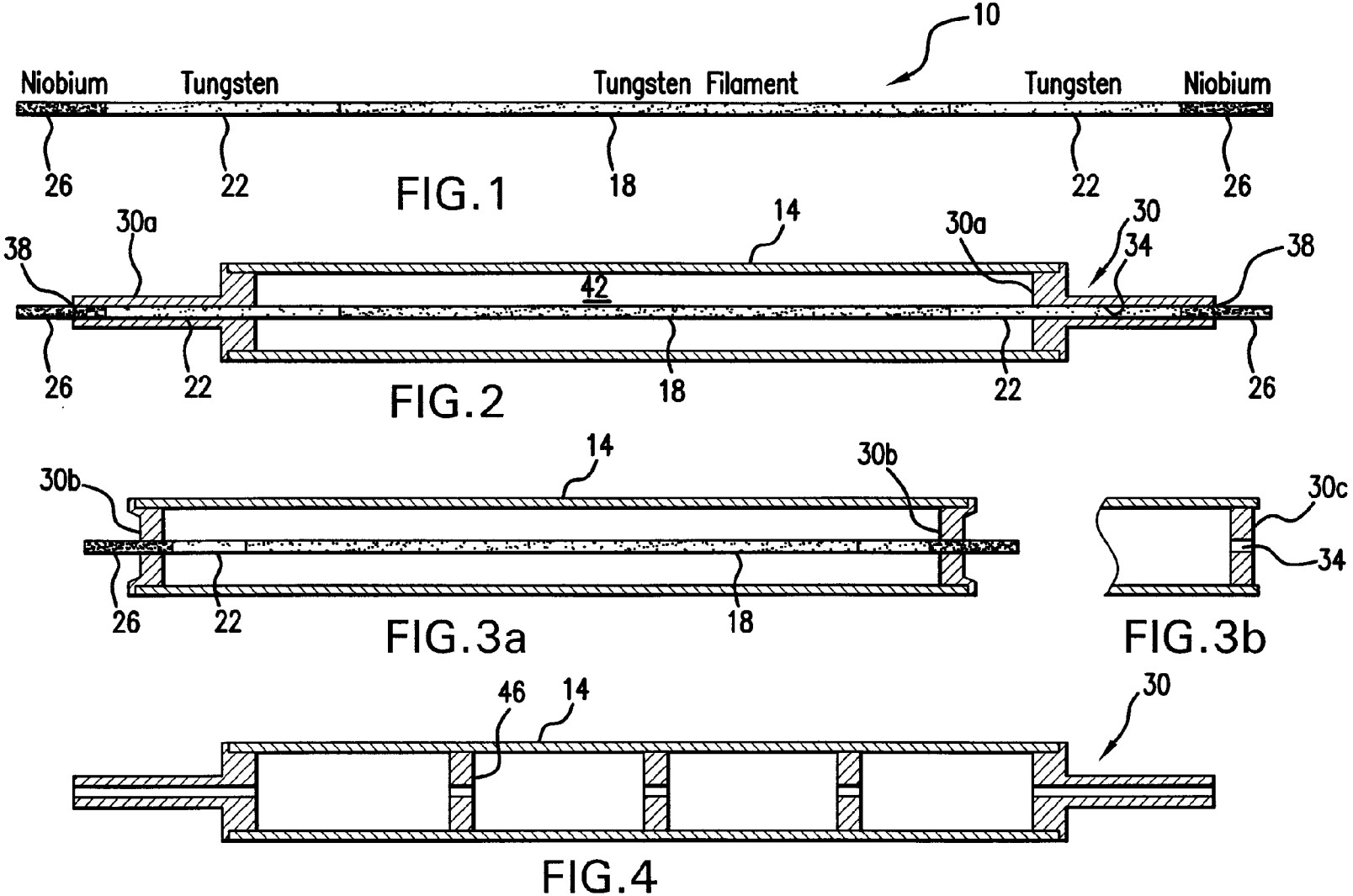
FIG. 1 is a pictorial representation of a filament assembly of a first embodiment of the present invention.
FIG. 2 is a cross section of the first embodiment of the present invention.
FIGS. 3*a-b* are cross sections of alternative embodiments of the end caps.
FIG. 4 is a cross section showing the spacers inside the envelope (filament assembly omitted in the interest of clarity).

A tungsten filament is an excellent emitter of infrared light and is therefore a suitable source of infrared emissions for the lamp of the present invention. The glass envelope used in a conventional incandescent lamp however is not a suitable transmitter of infrared radiation and is replaced in the present invention with a material that has a high transmission at 5 micron wavelengths and below, such as an aluminum oxide ceramic envelope. Single crystal aluminum oxide (sapphire) and polycrystalline aluminum oxide (PCA) are both suitable materials for the envelope. PCA has a much lower cost than sapphire and is therefore preferred.

With reference now to FIGS. 1-2, a first embodiment of a lamp of the present invention includes a filament assembly 10 inside a polycrystalline aluminum oxide (PCA) envelope 14. Preferably, filament assembly 10 has a coiled tungsten filament 18, solid metal ends 22 attached (e.g., welded) to distal ends of coiled tungsten filament 18, and first and second leads 26 attached (e.g., welded) to distal ends of solid metal ends 22. As used herein, the term "filament assembly" may alternately refer to the combination of the coiled tungsten filament and the solid metal ends with or without the leads attached thereto as will be clear from the context.

Preferably, the solid metal ends 22 are comprised of tungsten as shown in FIG. 1, however, molybdenum may also be used, particularly with halogen-containing gas fills. Alternatively, the function of the solid metal ends 22 and leads 26 may be combined into a single length of a suitable metal or metal alloy wire to form an extended lead that is capable of being welded to the tungsten filament 18 and has a coefficient of expansion that is compatible with the end caps.

End caps 30 are attached to ends of envelope 14 and each has an opening 34 through which a respective one of first and second leads 26 extends. First and second leads 26 are each made of a metal (such as niobium) having a coefficient of thermal expansion compatible with end caps 30. Preferably, first and second leads 26 are attached to end caps 30 with glass-ceramic sealing frits 38. End caps 30 and sealing frits 38 seal a suitable gas 42 inside envelope 14. It may also be possible to seal the leads directly to the end caps without an intermediate frit material by using leads comprised of a tungsten or molybdenum alloy having suitable thermal expansion properties. Such an alloy is described in U.S. Pat. No. 4,366,410.

As shown in FIGS. 2 and 3*a-b*, end caps 30 may be capillaries 30*a*, flanged end buttons 30*b* or recessed end buttons 30*c*. End caps 30 may be PCA or other suitable material. When flanged end buttons 30*b* or recessed end buttons 30*c* are used, solid metal ends 22 may be shortened compared to their length when capillaries 30*a* are used, such as illustrated in FIG. 3*a*.

As shown in FIG. 4, the lamp may also include spacers 46 that either are attached to filament assembly 10 (such as metallic spacers) and are adapted to engage an interior of envelope 14 during use of the lamp, or extend from an interior surface of envelope 14 (such as PCA inserts) and are adapted to support filament assembly 10 during use of the lamp. The latter spacers may be the same as or similar to end buttons 30*c* with openings through which filament assembly 10 extends. Spacers 46 keep coiled tungsten filament 18 from contacting envelope 14 during use of the lamp (reference is made to U.S. Pat. No. 4,532,455 that shows wire loop members that support a tungsten filament in an incandescent lamp.) By way of example, three spacers would be suitable to support a filament with a coil length of about 55 mm.

FIGS. 1-4 show the lamp as a double-ended lamp with a tubular envelope. This form is at present economical to produce (the technology for making this shape is well known) and is therefore preferred. Other shapes are also possible, such as single ended lamps and lamps with a curved envelope.

The method of making the lamp generally includes attaching end caps 30 and sintering envelope 14, inserting filament assembly 10 into envelope 14, and attaching first and second leads 26 to the respective end caps 30 with glass-ceramic sealing frits 38, thereby sealing gas 42 in envelope 14. The order of these steps may vary.

One approach is to insert the filament assembly into the envelope after sintering and after attaching the end caps and spacers by sliding the filament through the respective openings. Another approach is to put the filament assembly in the envelope prior to sintering. In the latter instance, the filament assembly would go through the sintering process that typically reaches a temperature of about 1850° C. It should be noted that mechanical properties of the niobium (if this material is used for the leads) will degrade when exposed to this sintering process. Further, the PCA envelope will shrink in length and diameter as it sinters to full density.

When an embodiment with spacers attached to the filament (the spacers being too large to fit through the end cap openings) and with niobium leads is being manufactured, first and second leads 26 preferably are attached to the respective distal ends of solid metal ends 22 after inserting filament assembly 10 (with the spacers attached but without the niobium leads) into the envelope and after sintering the envelope and attaching the end caps to envelope. This exposes the tungsten/molybdenum parts of the filament assembly to the sintering, but the tungsten/molybdenum parts are not as affected by this process as is the niobium.

This procedure may be accomplished by initially providing solid metal ends 22 that are longer than needed in the assembled lamp and inserting the filament assembly with longer ends 22 and no leads 26 into envelope 14. Then, after sintering the envelope, moving (e.g., sliding) the filament assembly longitudinally in envelope 14 to expose an end portion of one of the solid metal ends outside envelope 14 through a respective end cap opening 34, removing this end portion, and attaching the first of the niobium leads to a remnant of this solid metal end that remains exposed outside envelope 14. The second lead may then be attached to the other solid metal end by moving the filament assembly longitudinally in the opposite direction in envelope 14 to expose an end portion of the other solid metal end outside envelope 14 through the other end cap opening 34, removing this end portion, and attaching the second of the niobium leads to a remnant of the other solid metal end that remains exposed outside the envelope.

The step of attaching first and second leads 26 to respective ones of end caps 30 with glass-ceramic sealing frits 38 may include stretching coiled tungsten filament 18 to a desired length and holding the stretched tungsten filament in place (e.g., by clamping or temporarily welding stop-wires) while sealing the envelope with the glass-ceramic sealing frits.

Envelope 14 must be sealed with suitable gas 42 inside to provide an essentially oxygen-free atmosphere inside the lamp. The lamp may be filled with a gas similar to that used in halogen lamps (e.g., iodine- or bromine-containing gas fills at >1 atm cold fill pressure) or with high pressure xenon (e.g., at about 10 bar) or krypton to minimize evaporation of the tungsten from the filament that will deposit on the relatively cool wall of envelope 14 and reduce light emission.

The sealing process used for silica glass envelopes is not suitable with PCA. The process used herein is a known process used to seal electrodes in a high pressure sodium lamp or a ceramic metal halide lamp. The process uses glass-ceramic sealing frit 38 to bond first and second leads 26 to end caps 30. End caps 30 and first and second leads 26 should have similar coefficients of expansion to reduce the stress that would otherwise be generated by a mismatch in thermal expansion of these components. An exact match is not required.

Spacers 46 and end caps 30 may be made of PCA and co-sintered with the envelope.

In a further embodiment, spacers 46 are places where the envelope is pinched or otherwise reduced in diameter to hold the filament in place. In this embodiment, the coiled tungsten filament of the filament assembly is stretched to expand the distance between the turns of the coil in those locations where the diameter is reduced so as to avoid too much contact between the filament and the envelope. That is, the coiled filament is unevenly stretched with the most stretched parts (greatest turn-turn separation) aligning with the pinched parts of the envelope. This procedure is used in halogen lamps with fused silica glass envelopes and is applicable to the present invention.

While embodiments of the present invention have been described in the foregoing specification and drawings, it is to be understood that the present invention is defined by the following claims when read in light of the specification and drawings.

What is claimed is:

1. An incandescent lamp that emits infrared light, comprising:

a filament assembly inside a tubular polycrystalline aluminum oxide envelope, said filament assembly having a coiled tungsten filament, solid metal ends of tungsten or molybdenum attached to distal ends of said coiled tungsten filament and first and second leads at respective distal ends of said solid metal ends;

polycrystalline aluminum oxide spacers disposed within the tubular envelope, each spacer having an opening through which the filament assembly passes, the coiled tungsten filament being stretched in regions where coiled tungsten filament passes through the spacers; end caps attached to ends of said envelope, wherein said end caps each have an opening through which a respective one of said first and second leads extends and wherein said first and second leads are each made of an electrically conductive material having a coefficient of thermal expansion compatible with said end caps; and glass-ceramic sealing frits that attach each of said first and second leads to a respective one of said end caps, wherein said end caps and said sealing frits seal a gas inside said envelope.

2. The lamp of claim 1, wherein said end caps comprise one of capillaries, recessed end buttons, and flanged end buttons.

3. The lamp of claim 1, wherein the envelope contains a halogen-containing gas.

4. The lamp of claim 3, wherein the halogen-containing gas is an iodine-containing or bromine-containing gas at a cold fill pressure of >1 atm.

* * * * *